US005641385A

United States Patent [19]

Croft et al.

[11] Patent Number: 5,641,385

[45] Date of Patent: Jun. 24, 1997

[54] USE OF ETHYLENEAMINE FOR WASHING PULP CONTAINING LIGNIN

[75] Inventors: Alan P. Croft, Lake Jackson; Byford D. Sheffield, Brazoria, both of Tex.

[73] Assignee: The Dow Chemical Company, Midland, Mich.

[21] Appl. No.: 373,354

[22] Filed: Jan. 17, 1995

[51] Int. Cl.[6] ..... D21C 9/02

[52] U.S. Cl. ..... 162/60; 162/72; 162/90

[58] Field of Search ..... 162/60, 72, 81, 162/90, 166, 167

[56] References Cited

U.S. PATENT DOCUMENTS

| | | | |
|---|---|---|---|
| 3,893,941 | 7/1975 | Michalski et al. | 162/60 |
| 3,951,732 | 4/1976 | Sjöström et al. | 162/65 |
| 4,045,280 | 8/1977 | Mackie | 162/65 |
| 4,067,768 | 1/1978 | Mackie | 162/65 |
| 4,298,428 | 11/1981 | Breslin et al. | 162/73 |
| 4,455,257 | 6/1984 | Hoftiezer et al. | 260/124 |
| 4,552,616 | 11/1985 | Kauppi | 162/72 |
| 4,790,905 | 12/1988 | Nivelleau de La Bruniere et al. | 162/56 |
| 4,810,328 | 3/1989 | Freis et al. | 162/60 |
| 5,151,130 | 9/1992 | Croft et al. | 106/778 |
| 5,229,294 | 7/1993 | Foster | 436/8 |

OTHER PUBLICATIONS

James Casey, "Pulp & Paper, Chemistry & . . . Chemical Technology", 3rd Edition, vol. I, 1980, p. 26.

Josephson, William E. et al., "Multi-component control of brownstock washing", vol. 76, No. 9 Tappi Journal, pp. 197–204, (Sep. 1993).

Encyclopedia of Chemical Technology, "Defoamers", 4th ed., vol. 7, pp.928–945.

Li, Pei and Pelton, Robert, "Wood pulp washing 2. Displacement washing of aqueous lignin from model beds with cationic polymer solutions", Colloids and Surfaces, 64 (1992), pp. 223–224.

Thayer, Ann M., "Paper Chemicals", C&EN Northeast News Bureau, pp. 28–41, Nov. 1, 1993.

Kirk–Othmer Encyclopedia of Chemical Technology, 3rd ed., vol. 16, "Fibrous Raw Materials", pp. 769–771, (1981).

Chemical Abstract 108:223335n, Chemical Abstracts vol. 108, 1968, p. 84.

Chemical Abstract 86:157348t, Chemical Abstracts vol.86, 1977, p. 102.

Chemical Abstract 100460m, 43—Wood Products, vol. 82, 1975, p. 100470.

Chemical Abstract 89:131348c, 43—Wood Products, vol. 89, 1978, p. 131364.

Chemical Abstract 93:74128q, 43—Wood Products, vol. 93, 1980, p. 74141.

Chemical Abstract 119:30239c, Chemical Abstracts vol. 119, 1993, p. 120.

Chemical Abstract 65581t, 43—Wood Products, vol. 67, 1967, p. 65590.

Derwent Abstract 91–358615/49, 28, Oct. 1991, (J0 3–241, 084–A).

Derwent Abstract 92–100104/13, 12, Feb. 1992, (J0 4–41, 797–A).

*Primary Examiner*—Donald E. Czaja

*Assistant Examiner*—Dean T. Nguyen

[57] ABSTRACT

Ethyleneamines are used in washing pulp to remove lignin. A process for washing a cellulose pulp mixture containing lignin to remove at least a portion of the lignin therefrom comprises use of a washing composition with at least about 100 ppm of an ethyleneamine. The process includes an improvement in a washing process a cellulose pulp mixture containing lignin wherein a washing composition is used to remove at least a portion of the lignin, the improvement comprising use of at least about 100 ppm of an ethyleneamine with the washing composition and/or using an amount of ethyleneamine at least equivalent to about 100 ppm based on the washing composition with the washing composition. The washing composition is also novel and includes a washing composition for washing kraft pulp comprising water and at least about 100 ppm of an ethyleneamine.

16 Claims, 1 Drawing Sheet

USE OF ETHYLENEAMINE FOR WASHING PULP CONTAINING LIGNIN

This invention relates to removal of lignin, particularly to the use of amines in such removal. In one more particular aspect, the invention relates to brownstock washing.

Removal of lignin is a common problem especially in dealing with wood pulps. Wood pulps include pulps such as chemical (e.g. kraft process), thermomechanical, mechanical, chemimechanical, chemithermomechanical or groundwood pulp.

The need for facile lignin removal is especially evident in kraft pulping processes. These processes are well known in the art and include digestion of pulp using an alkaline medium, preferably containing an inorganic hydroxide, to release cellulose fibers from other components such as lignin. After digestion, fibers are commonly released under pressure into a tank in a process referred to as blowing or blowdown. Then the pulp is washed to remove spent chemicals, lignin and other organic chemicals. The liquid removed from the pulp is referred to as black liquor and contains about 25 percent dissolved solids, about 50 percent of which are organic, primarily lignin solubilized as phenolates or carboxylates, other cellulosic material, and sodium soaps. After this washing stage, which is referred to as brownstock washing, the pulp is optionally bleached before being made into paper. The black liquor resulting from the washing stage is called "weak black liquor" and is commonly concentrated by evaporation to a desired concentration and burned to reclaim the inorganic chemicals and provide fuel value. The organic materials are advantageously incinerated. Brownstock washing is described in more detail, for instance, by Josephson et al., "Multicomponent Control of Brownstock Washing," *Tappi Journal*, v. 76, no. 9, pp. 197–204 (1993).

Removal of lignin from the pulp is important because lignin carried over into a bleaching step results in a higher requirement for bleaching chemicals including additives and for effluent treatment. Poorly washed pulp is believed to be a source of precursors for certain dioxins and chlorinated furans during bleaching. It is also important to minimize the wash water used to remove lignin because any water in excess of the amount desired in the black liquor requires energy for removal, e.g. evaporation, from the liquor and may result in a greater cooking chemical makeup requirement for reuse of a black liquor. Ineffective washing can lead to foaming in screening and papermaking operations and to high requirements for pH control chemicals in later stages. There is increasing environmental pressure to reduce effluent and have more complete recycling of all components of the process, including water; therefore, use of less water becomes more desirable.

In spite of the importance of optimizing lignin removal, especially brownstock washing, most additives for papermaking have addressed problems in the bleaching and papermaking steps. See, Thayer, Paper Chemicals, *Chemical and Engineering News*, Nov. 1, 1993. pp. 28–42. However, Li et al, in *Colloids and Surfaces*, 64 (1992) pp. 223–234 report tests using cationic poly(diallyldimethylammonium chloride) or poly(DADMAC) to increase efficiency of the displacement of aqueous kraft lignin from a bed of glass beads designed to model the displacement washing characteristics of pulp fiber pads on kraft brownstock washers. They also report earlier work on non-reacting water-soluble polymers and show some work with a lower molecular weight polyamine available from Allied Colloids under the trade designation Percol 1597, now known to be polymeric propenaminium, dimethylpropenyl chloride (CAS 26062-79-3), which was said to have a behavior little different from the poly(DADMAC). These quaternary amine polymers were used in amounts of 250 to 1500 mg/L which corresponds approximately to about 250 to 1,500 ppm (parts per million by weight). It was observed that performance of lower molecular weight poly(DADMAC) was significantly worse than the other polymers and that use of the cationic polymers resulted in a colloidal phase in the eluate. All observations were reported to be consistent with a clotting mechanism. Dealing with a colloidal suspension in the black liquor requires extra handling and equipment.

It would be desirable to have an additive to improve lignin removal which avoids formation of a colloid in the wash water.

SUMMARY OF THE INVENTION

In the practice of the invention, ethyleneamines are used in the washing of pulp, especially brownstock washing in kraft pulp processes to improve lignin removal.

The invention includes a process for washing a cellulose pulp mixture containing lignin to remove at least a portion of the lignin therefrom comprising use of a washing composition with at least about 100 ppm of an ethyleneamine.

Additionally, the invention includes an improvement in a process for washing a cellulose pulp mixture containing lignin wherein a washing composition is used to remove at least a portion of the lignin, the improvement comprising use of at least about 100 ppm of an ethyleneamine with the washing composition.

In another aspect, the invention is an improvement in brownstock washing of cellulose pulp containing lignin with a washing composition, the improvement comprising using an amount of ethyleneamine at least equivalent to about 100 ppm based on the washing composition with the washing composition.

In yet another aspect, the invention includes a washing composition for washing kraft pulp comprising water and at least about 100 ppm of an ethyleneamine.

DETAILED DESCRIPTION OF THE INVENTION

Figure 1:
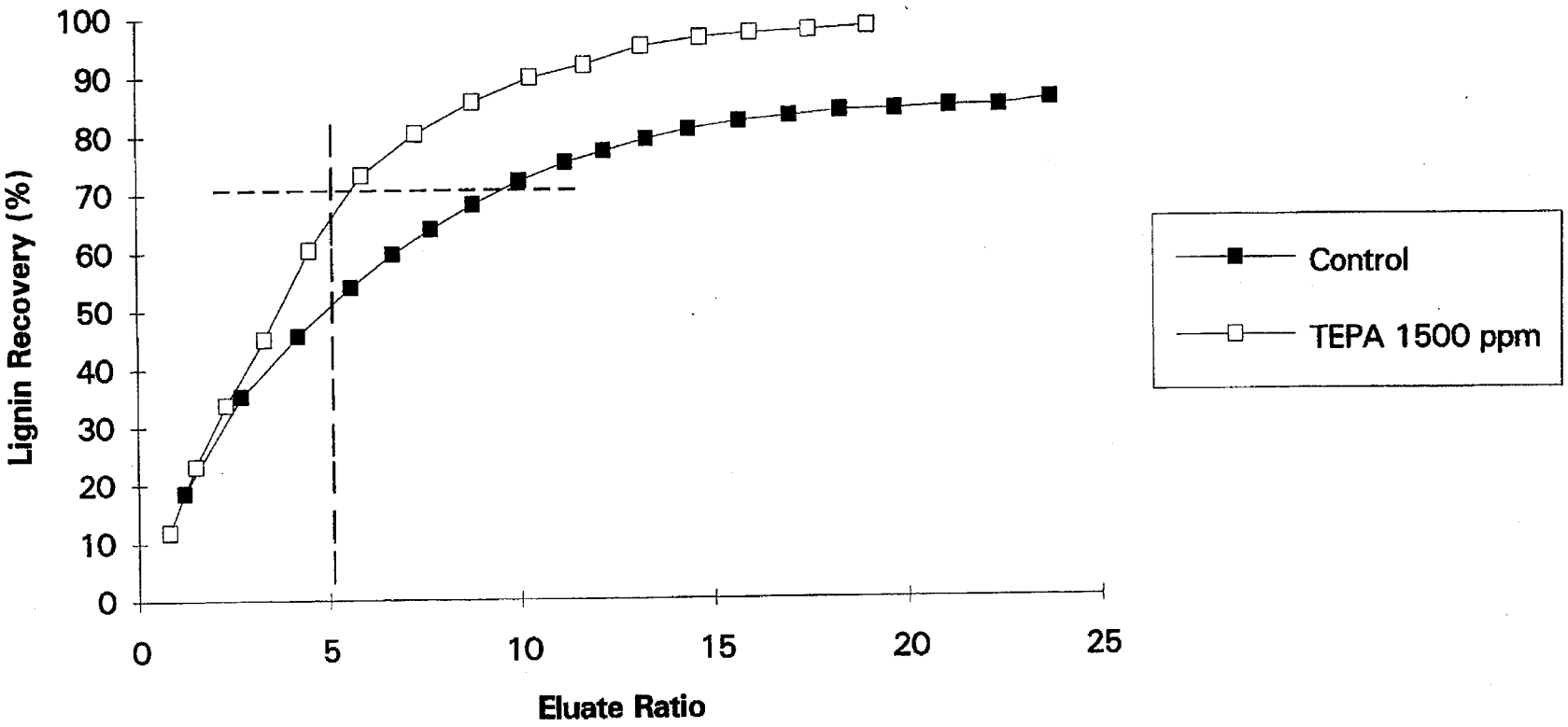
FIG. 1 is a graphical representation of lignin removal by amounts of eluate comparing water alone with the practice of the invention.

Washing processes for removing lignin are within the skill in the art and include brownstock washing processes as well as any other process wherein lignin is removed from a cellulose pulp mixture containing lignin, preferably cellulose fiber, using a washing composition. Brownstock washing processes are preferred in the practice of the invention because brownstock is a pulp widely produced using a chemical digestion process and requires washing to remove spent inorganic digestion chemicals, fatty acids, lignin, lignosulfonates, and other undesired organic chemicals to produce a desired paper. Brownstock washing is widely practiced and is under environmental pressure to achieve improvements in effectiveness.

The term "cellulose pulp mixture containing lignin" is used to mean a pulp mixture wherein the cellulose and lignin are sufficiently separated that at least a portion of the lignin is soluble or dispersible in water (hereinafter free lignin) rather than so intimately adhered or chemically bound to the cellulose that it is insoluble (hereinafter bound lignin). Removal of bound lignin from the pulp is not necessary. This invention is, therefore, addressed to removal of free lignin. Any cellulose pulp mixture containing free lignin is suitably used in the practice of the invention. Cellulose pulp mixtures containing lignin are well known in the art. Cellulose commonly occurs with lignin as the resinous adhesive that holds fibers of cellulose together. A pretreatment is advantageous to treat pulp to separate the cellulose and lignin sufficiently for the lignin to be at least partially free. Such pretreatments are within the skill in the art for instance digestion of wood or other cellulose source using an alkaline medium such as in known papermaking processes, preferably kraft paper processes. The processes are often referred to in the art as delignification.

This invention is applicable to any cellulosic pulp. Such pulps include wood pulps such as chemical (e.g. kraft process), thermomechanical, mechanical, chemimechanical, chemithermomechanical or ground pulp and fibers contained therein. Processes of preparing such pulps are within the skill in the art for instance as discussed in Casey, *Pulp and Paper; Chemistry and Chemical Technology,* 3rd ed., vol. 1, (1980) especially pages 291–491 and 504–567. In chemical pulps, the wood or other cellulose source is advantageously separated into pulp with the help of sulfate or sulfite materials, preferably for the practice of the invention sulfates and hydroxides. In mechanical and thermomechanical processes, pulp is separated by grinding or otherwise disintegrating the cellulose source. While lignin is not commonly removed from mechanical pulps, presence of large amounts of lignin can result in poor light stability, permanence and strength; therefore, removal can be desirable. Hardwood and softwood pulps and mixtures thereof are suitable for the practice of the invention as are pulps obtained from cotton, bagasse, esparto, hemp, kenaf and the like. Wood pulps are preferred because of their higher lignin content. Pulps obtained by alkaline processes are preferred because the process produces large quantities of undesired by products that must be removed from the pulp before further processing of the pulp into paper is possible.

Use of a washing composition in a process for removing lignin from a cellulose pulp mixture is within the skill in the art such as is discussed in Casey, *Pulp and Paper: Chemistry and Chemical Technology,* 3rd ed., vol. 1, (1980) especially pages 442–452. Commonly, the pulp mixtures containing lignin are filtered such as by pouring or blowing the mixture on a screen or other perforated surface. Liquid separates and is preferably collected; then the material remaining on the filter is washed, for instance, by pouring, pulling or spraying a washing composition through or otherwise contacting it with the material on the filter. Those skilled in the art will recognize that there are many variations in washing processes. For instance, countercurrent washing is sometimes used. Methods of washing commonly include dilution, extraction, and/or displacement. Most washing processes in the art use an aqueous composition, commonly water, for some type of contact (e.g. admixing, spraying, pouring) with a pulp mixture containing lignin. The washing composition and materials soluble or suspended therein are advantageously removed by any method within the skill in the art, preferably by being flowed, forced or drawn through the pulp mixture, but optionally by other means of separation of liquids from solids such as by centrifugation. A rotary vacuum filter is commonly used and is a drum partially immersed in a vat that is fed with a slurry of the stock to be washed; a mat of pulp forms on the outer surface of the drum where it is sprayed with washing composition, preferably water. Repulping optionally occurs between such drums in a series. Alternatively, washing at least partially takes place inside batch digesters. Other washing processes include the use of batch diffusers.

Washing processes such as brownstock washing are known to remove inorganic compounds as well as lignin. The inorganic compounds include those introduced, for instance in a chemical digestion process. In the practice of the invention, these inorganic materials are also advantageously removed. The inorganic materials are believed to be bound or associated with the lignin in most situations where they are present, particularly in brownstock washing.

Composition of a washing composition depends on the washing process used. Such compositions are within the skill in the art. For instance, in brownstock washing, water is commonly used as the washing composition, but additives within the skill in the art are optionally present, preferably additives which do not undesirably interfere with the action of the ethyleneamine. Such washing compositions include for instance defoaming additives (defoamers) within the skill in the art, including for instance hydrocarbons, oils, fatty alcohols, fatty esters, fatty acids, poly(alkylene oxides) especially poly(ethylene oxide) or poly(propylene oxide) derivatives and copolymers, organic phosphates, hydrophobic silica especially in hydrocarbon oils, and especially silicone compounds. While aqueous washing compositions are preferred in the practice of the invention, washing compositions alternatively comprise other solvents, suitably any solvents which remove lignin and/or other black liquor components, preferably in which lignin, preferably with any associated inorganic materials, is at least partially soluble or dispersible. Such solvents include alcohols, ketones, heterocyclic compounds, polyethers and the like and mixtures thereof. Additives are also optionally present in solvent washing compositions. Water and other solvents are optionally used together in washing compositions.

The term "ethyleneamine" is used to mean an amine having at least one ethyleneamine unit or repeating ethyleneamine units. An ethyleneamine unit is —($CR_2$—$CR_2$—NH—)— where R is H or an alkyl (straight, branched or cyclic) group, preferably H, but if alkyl of from about 1 to about 10 carbon atoms. Ethyleneamines have at least two amine groups, which groups are primary or secondary amine groups; tertiary amine groups are optionally also present. Thus, ethyleneamines include ethylenediamine, diethylenetriamine, triethylenetetramine, tetraethylenepentamine, piperazine, aminoethylpiperazine, ethyleneamine mixtures such as mixtures of ethyleneamine oligomers having an average molecular weight of about 250–300 commercially available from The Dow Chemical Company under the trade designation Ethyleneamine E-100, and other mixtures thereof. In the case of ethyleneamines having isomers, one isomer or a mixture of isomers is suitably used in the practice of the invention. Amines rather than their salts or quaternary compounds are used to interact with the lignin. It is preferred that the ethyleneamine be soluble in the washing composition; therefore, the molecular weight or average molecular weight in the case of a mixture of the ethyleneamines is preferably sufficiently low to retain solubility in the washing composition, preferably in water. More preferably, the molecular weight or average molecular weight is less than about 500, more preferably less than about 450, most preferably less than about 400. It is noted that among ethyleneamines having an (average) molecular weight less than about 500, that heavier amines are often more effective. Therefore, amines having a molecular weight of at least about 150 are preferred, with at least about 170 more preferred and at least about 200 most preferred. Among ethyleneamines, triethylenetetramine, tetraethylenepentamine, piperazine, aminoethylpiperazine, and mixtures of ethyleneamine oligomers having an average molecular weight of about 200–500 are preferred with tetraethylenepentamine, piperazine, aminoethylpiperazine, and mixtures of ethyleneamine oligomers having an average molecular weight of about 250–500 more preferred and piperazine, aminoethylpiperazine, and mixtures of ethyleneamine oligomers having an average molecular weight of about 250–450 most preferred.

Conditions of use are not critical to the invention. However, washing is expected within the art to be more efficient at elevated temperatures than at temperatures at or below room temperature. It is, however, preferred that the solvents in the washing composition do not boil away in the washing step. Thus, temperatures of from about room temperature (25° C.) to about the boiling point of the solvent, 100° C., in the case of water are preferred, with from about 40° to about 85° C. more preferred and from about 60° to about 80° C. most preferred. A temperature of about 170° F. (77° C.) is conveniently used in brownstock washing because that is a common temperature of water coming from evaporators.

The ethyleneamines are used with the washing compositions in any amount effective to remove lignin more effectively than the same composition used in the same manner without the amine; however, it is found that amounts of ethyleneamine equivalent to at least about 100 or 200 ppm by weight based on washing composition are generally preferably for observable improvements from the washing composition without the ethyleneamine. At room temperature, at least about 500 ppm is preferred. More preferably, at room temperature at least about 1000 ppm is used, most preferably at least about 1500 ppm is used, but less is preferred at higher temperatures, advantageously at least about 500, more preferably at least about 1000 ppm. To avoid wasting amine and to avoid disposing of excess amine, preferably the ethyleneamine is used in an amount insufficient to reduce effectiveness and more preferably no greater than that above which no significant improvement in removal of lignin or other component, particularly black liquor components, is observed. In brownstock washing, it is found at room temperature that above about 2000 ppm effectiveness is reduced and above about 1500 ppm very little significant improvement is observed at concentrations; therefore, amounts preferably not greater than about 2000, more preferably 2000 ppm is used at room temperature. At higher temperatures, less amine is needed, therefore, advantageously less than about 1500 ppm, preferably less than about 1200 ppm, more preferably less than about 1000 ppm ethyleneamine is used.

The ethyleneamine is used with the washing composition. Preferably, the ethyleneamine is used in (as a component of) the washing composition, more preferably in the washing composition at the concentrations discussed previously. Alternatively, the ethyleneamine is contacted with the pulp such that it increases the effectiveness of the washing composition. For instance, the ethyleneamine is advantageously contacted with pulp, e.g. on a screen or filter, e.g. by being sprayed or poured thereon, before the washing composition is contacted with the pulp. It is expected that use in the washing composition is most efficient, and that other methods use more amine. Thus, the preferred amounts of amine for contact other than as a part of the washing composition, are somewhat greater than the preferred amounts previously discussed. Those skilled in the art can determine optimum amounts of amine to be used in alternative methods given the data herein.

Improvement in lignin removal is noted in at least two ways. First, at a constant amount of eluate (water or other composition used to wash the cellulose pulp mixture containing lignin) an increase in lignin removal is noted. Second, and alternatively, less eluate is required to achieve a given percentage of lignin removal. The relative importance of the two methods depends on the conditions of a particular washing process. In a process designed for the use of a given amount of washing composition, for instance with distillation or evaporation apparatus sufficient for a given amount of eluate, it is important to remove as much lignin as possible with the amount of washing composition for which the process is designed because there will be less lignin going to the next stage, usually a bleaching stage, where lignin can interfere and results in disposal problems as discussed previously. Alternatively, when a predetermined amount or percentage of lignin needs to be removed, it is useful to do so using the least volume of washing composition to avoid excessive energy and equipment requirements for evaporation, distillation or other treatment of the excess water and other washing composition components.

These two types of improvement in lignin removal are illustrated in FIG. 1 where the line marked by shaded squares represents washing with water alone and the line marked by open squares represents washing with water containing an ethyleneamine, in this case tetraethylenepentamine, according to the practice of the invention. The vertical dashed line starts at 5 volumes of eluate for each volume of added black liquor and shows by its intersection of the shaded squares line that about 50 percent by weight of the lignin is removed by washing with water, while the intersection of the open square line shows that about 65 percent by weight of the lignin is removed by washing with water containing tetraethylenepentamine according to the practice of the invention. Similarly, the horizontal dashed line at 70 percent by weight lignin removal shows that washing with water containing tetraethylenepentamine requires about 6 volumes per volume of added black liquor according to the practice of the invention; while the water alone requires about 10 volumes per volume of added black liquor by the intersection with the shaded squares line.

In graphs of eluate ratio against lignin removal such as in FIG. 1, a plateau is noted. This plateau represents total lignin removal because use of more washing composition does not result in removal of significantly more lignin. (At best only very slight amounts are removed with additional washing such that a plateau is observed.) Preferably, in the practice of the invention one observes higher total lignin removal than is observed for pure water or washing compositions corresponding to those used in the practice of the invention except for the ethyleneamine.

Improvement in washing cellulose pulps containing lignin according to the practice of the invention can also be shown using the parameters DF(dilution factor) and, especially, DR (displacement ratio) as known in the art and explained by Josephson et al., "Multi-component Control of Brownstock Washing," Tappi Journal, v. 76, no. 9, pp. 197–204 (1993) at page 198.

The following examples are offered to illustrate but not limit the invention. All ratios, percentages and parts are by weight unless otherwise indicated. Examples (Ex.) of the invention are designated numerically, while the comparative sample (C.S.) which is not an example of the invention is designated alphabetically.

EXAMPLES 1–20 and Comparative Sample A: Effectiveness of Various Ethyleneamines Compared to Water For each Example and Comparative Sample, a model washing bed is constructed using a 50 mm diameter cylindrical glass funnel containing a compressed mat of kraft pulp. A measured portion of black liquor is placed on the pulp mat and then water or other solutions of the test additives are used to wash the test bed. The wash liquid is added to the top of the bed by a small pump. Fractions of eluate are collected from the outlet of the test bed using a fraction collector. The eluate fractions are weighed and then analyzed for lignin concentration using IIV spectroscopy. Eluate volumes and lignin concentrations are determined for each of the collected fractions. Washing efficiencies for solutions containing the test additives are compared to the washing efficiency for distilled water in the washing experiments.

A solution at each of the concentrations indicated in Table 1 of each of the following additives is tested and compared to a control (C.S. A) where distilled water is substituted for the test solution: ethylenediamine (EDA), diethylenetriamine (DETA), triethylenetetramine (TETA) (isomer mixture), tetraethylenepentamine (TEPA) (isomer mixture), Ethyleneamine E-100 (E-100), piperazine (PIP), Piperazine Amine Mix containing principally piperazine, with a minor amount of DETA, and water (about 30 percent by weight) (PIP Amine), aminoethylpiperazine (AEP), and aminoethylethanolamine (AEEA). The washing efficiencies are calculated for two different lignin recovery levels (70 percent and 80 percent). The eluate ratios, washing efficiency improvements at 70 percent and 80 percent lignin recovery, and the total lignin recovery for the series of test additives are tabulated in Table 1.

The washing apparatus consists of the following major pieces of equipment: a glass funnel made in two parts, the upper cylindrical part and the lower conical part joined with flange joints and O-ring seals, sandwiching a 70 micron ($70\times10^{-6}$ m) mesh fluorocarbon filter screen and a perforated fluorocarbon polymer support plate. (The upper portion of the glass funnel is fitted with a side arm in order to control the level of wash solution in the test bed; the bed contains a mat of prepared kraft brownstock pulp); a peristaltic pump to deliver the wash solution to the test bed using tubing; a controller to maintain a constant level in the wash bed; and a fraction collector loaded with 13×100 mm test tubes to collect the wash eluate.

Ultraviolet absorbance analyses of the wash eluate are performed with a spectrophotometer using a quartz cuvette with a path length of 1.0 cm. Synthetic lignin solution (614.5 g) is prepared by mixing 12.5 g of Indulin C (lignin, sodium salt) commercially available from WESTVACO Chemical Company, 100.0 g sucrose, 2.0 g sodium hydroxide pellets, and 500 g of distilled water in a flask. Analytical standards are prepared by filling five 100 ml volumetric flasks to the 100 ml mark with pH 10.0 buffer, then adding 25, 50, 75, 100, and 125 microliters of synthetic lignin solution, respectively, to each of the five volumetric flasks. The solutions are mixed completely by shaking. The UV spectrometer is calibrated using the five standards using 280 nm for the analytical wavelength. The concentration of lignin in the black liquor is determined by UV spectroscopy.

The wash solutions are prepared by weighing out the desired amount (one gram for Examples 2, 6, 10, 14, and 18 where a 1000 ppm concentration is used) of additive and adding distilled water to the mark in a 1000 ml volumetric flask. The concentration of the active ethyleneamine additive in the solution is given in Table 1.

The model wash bed is assembled by locking the support plate (bottom) and the 70 micron ($70\times10^{-6}$ m) mesh filter (top) between the flange faces of the two parts (cylindrical top and conical bottom) of the glass funnel with a flange clamp. The assembled funnel is suspended above a vacuum flask with a ring stand and clamps. A vacuum line is attached to the outlet of the wash bed.

The kraft brownstock mat is prepared by placing 19.06 g of 23.09 percent consistency pulp (equivalent to 4.40 g of oven-dried pulp) in a 600 ml beaker. To the beaker is added 200.0 g of distilled water and a magnetic stir bar. The beaker is placed on a magnetic stirrer and the slurry stirred at high speed for 5 minutes. The beaker is taken from the stirrer and the stir bar removed. The pulp slurry is transferred from the beaker to the wash bed. Following transfer, vacuum is applied to the outlet of the bed for 2 minutes to remove the water and form a pulp mat. Then the vacuum line is removed and the model washing device containing the prepared pulp is suspended above the fraction collector using a ring stand and clamps. The sensor for the level controller is attached to the side arm to maintain the liquid level in the bed.

Eight wash solution delivery lines are passed between the wash solution reservoir (flask), the peristaltic pump, and the test bed using plastic tubing. The inlet ends of the wash solution delivery tubing are inserted into the flask containing the amine wash solution, and primed using the peristaltic pump. A 5.0 ml aliquot of the black liquor solution (density 1.0147 g/ml) is added to the kraft pulp bed using a pipette. Care is taken to insure a uniform lo loading. The loaded bed is then covered with a piece of filter paper (Whatman No. 1) to prevent disturbance of the bed by the addition of the wash solution. The outlet ends of the delivery lines from the pump are then inserted into the top of the glass funnel above the pulp bed, with the tubing ends about 2.0 cm above the level to be maintained by the wash solution. The sample collector is loaded with clean tubes. The level controller, pump, and sample collector are turned on and the correct liquid level is obtained above the bed. Normal operation is then maintained until the end of the wash cycle. Sampling interval is controlled manually by the operator. Samples are collected until all visible color is gone from the eluate. The sample collector, level controller, and pump are then turned off.

The test tubes containing the eluate samples from the collector are then weighed. As many 100 ml volumetric flasks as there are collected samples are filled to the 100 ml mark with pH 10.0 buffer. The flasks are numbered, corresponding to the numbers of the test tubes in the fraction collector tray. To the first of the numbered volumetric flasks containing the buffer is added 100 microliters of eluate from the first test tube. The flask is then shaken to facilitate mixing. This procedure is repeated for all the remaining samples. All the samples are then analyzed by UV spectroscopy and the lignin concentrations are determined. The eluate ratio at 70 and 80 weight percent removal and the total lignin recovery are recorded in Table 1. When the 70 and 80 percent removal points are not exactly represented by experimental data points, they are extrapolated from the data points before and after the recorded lignin removal levels by computer. Computer results are believed to allow reporting in more precision than would reading the same points from a graph similar to that of FIG. 1 for each washing composition.

TABLE 1

Eluate Ratios and Washing Efficiencies for Selected Washing Additive Candidates at 70 percent and 80 percent Lignin Recovery

| Ex. or C.S. | Additive Identity | Additive Conc. (ppm) | Eluate Ratio @ 70% Lignin Recovery | Eluate Ratio @ 80% Lignin Recovery | Washing Efficiency Improvement (%) @ 70% Lignin Recovery | Washing Efficiency Improvement (%) @ 80% Lignin Recovery | Total Lignin Recovery (%) |
|---|---|---|---|---|---|---|---|
| C.S. A* | None | 0 | 9.37 | 13.78 | 0.0 | 0.0 | 85.7 |
| Ex. 1 | Ethylenediamine | 500 | 9.11 | | 2.8 | | 76.1 |
| Ex. 2 | Ethylenediamine | 1000 | 8.82 | 12.35 | 5.9 | 10.4 | 87.7 |
| Ex. 3 | Ethylenediamine | 1500 | 8.21 | 12.52 | 12.4 | 9.1 | 84.2 |
| Ex. 4 | Ethylenediamine | 2000 | 9.66 | | −3.1 | | 80.8 |
| Ex. 5 | Diethylenetriamine | 500 | 8.66 | | 7.6 | | 79.6 |
| Ex. 6 | Diethylenetriamine | 1000 | 8.70 | 14.11 | 7.2 | −2.4 | 85.4 |
| Ex. 7 | Diethylenetriamine | 1500 | 7.40 | 10.80 | 21.0 | 21.6 | 87.1 |
| Ex. 8 | Diethylenetriamine | 2000 | 8.32 | 12.01 | 11.2 | 12.9 | 84.9 |
| Ex. 9 | Triethylenetetramine | 500 | 7.77 | 13.1 | 17.1 | 4.9 | 80.8 |
| Ex. 10 | Triethylenetetramine | 1000 | 8.18 | 11.54 | 12.7 | 16.3 | 88.0 |
| Ex. 11 | Triethylenetetramine | 1500 | 7.79 | 12.17 | 16.9 | 11.7 | 85.0 |
| Ex. 12 | Triethylenetetramine | 2000 | 7.42 | 10.78 | 20.8 | 21.8 | 86.3 |
| Ex. 13 | Tetraethylenepentamine | 500 | 8.08 | 12.17 | 13.8 | 11.7 | 83.7 |
| Ex. 14 | Tetraethylenepentamine | 1000 | 7.06 | 10.04 | 24.7 | 27.1 | 89.4 |
| Ex. 15 | Tetraethylenepentamine | 1500 | 5.55 | 7.22 | 40.8 | 47.6 | 98.6 |
| Ex. 16 | Tetraethylenepentamine | 2000 | 6.57 | 9.05 | 29.9 | 34.3 | 88.6 |
| Ex. 17 | Ethyleneamine E-100** | 500 | 7.50 | 11.90 | 20.0 | 13.6 | 86.4 |
| Ex. 18 | Ethyleneamine E-100** | 1000 | 6.69 | 9.54 | 28.6 | 30.8 | 88.7 |
| Ex. 19 | Ethyleneamine E-100** | 1500 | 6.96 | 9.11 | 25.7 | 33.9 | 95.6 |
| Ex. 20 | Ethyleneamine E-100** | 2000 | 9.31 | 13.2 | 0.6 | 4.2 | 88.0 |

% is percent by weight
*Not an example of the invention.
**A mixture of ethyleneamines having an average molecular weight of about 150–300 commercially available from the Dow Chemical Company.

Examination if the entries in Table 1 shows that all the tested materials demonstrate improvement in washing efficiency at 70 percent lignin recovery (5.9–28.6 percent)in amounts of ethyleneamine less than 2000 ppm. At 80 percent lignin recovery, all additive candidates except DETA in amounts of ethyleneamine less than 2000 ppm show improvement in washing efficiency (1.2–30.8 percent). DETA shows improvement when used in amounts of 1000 and 2000 ppm. Of the additives tested, TEPA and E-100 are the most effective at improving washing efficiency. These ethyleneamines also show consistent improvement in total lignin recovery when used in amounts greater than about 500 ppm. In general there is some trend toward increased performance with increasing molecular weight of the homologs in the ethyleneamine series. The variation in effectiveness with amount of ethyleneamine indicates that optimum amounts of ethyleneamine vary with the specific amine but can be determined by these procedures.

No colloids are observed in the eluates.

We claim:

1. A process for washing a cellulose pulp mixture containing lignin to remove at least a portion of the lignin therefrom comprising (1) filtering the cellulose pulp mixture containing lignin to form a mat of the pulp; and (2) washing the mat with a washing composition consisting essentially of an aqueous solution of at least about 100 ppm of an ethyleneamine wherein the ethyleneamine has an average molecular weight of about 150 to about 500.

2. The process of claim 1 wherein the cellulose pulp is a wood pulp processed using a hydroxide.

3. The process of claim 2 wherein the cellulose pulp is a kraft pulp.

4. The process of claim 1 wherein the ethyleneamine has at least one —($CR_2$—$CR_2$—NH—)— unit wherein each R is independently selected from H or alkyl of from 1 to about 10 carbon atoms.

5. The process of claim 4 wherein the ethyleneamine has a molecular weight of less than about 500.

6. The process of claim 4 wherein the ethyleneamine is selected from ethylenediamine, diethylenetriamine, triethylenetetramine, tetraethylenepentamine, piperazine, aminoethylpiperazine, mixtures of ethyleneamine oligomers having an average molecular weight of about 250–300, and other mixtures thereof.

7. The process of claim 6 wherein the ethyleneamine is selected from ethyleneamines, triethylenetetramine, tetraethylenepentamine, piperazine, aminoethylpiperazine, and mixtures of ethyleneamine oligomers having an average molecular weight of about 200–500.

8. The process of claim 6 wherein the ethyleneamine is selected from tetraethylenepentamine, piperazine, aminoethylpiperazine, and mixtures of ethyleneamine oligomers having an average molecular weight of about 250–500.

9. The process of claim 6 wherein the ethyleneamine is selected from piperazine, aminoethylpiperazine, and mixtures of ethyleneamine oligomers having an average molecular weight of about 250–450.

10. The process of claim 9 wherein the ethyleneamine is used in an amount of from at least about 100 ppm to about 2000 ppm.

11. The process of claim 1 wherein the ethyleneamine is used in an amount of at least about 500 ppm.

12. The process of claim 11 wherein the ethyleneamine is used in an amount of at least about 1000 ppm.

13. The process of claim 12 wherein the ethyleneamine is used in an amount of at least about 1500 ppm.

14. The process of claim 1 wherein the ethyleneamine is used in an amount of from at least about 500 ppm to about 1500 ppm.

15. In a process for washing a cellulose pulp mixture containing lignin wherein a washing composition is used to remove at least a portion of the lignin, the improvement comprising using a washing composition consisting essentially of an aqueous solution of at least about 100 ppm of an ethyleneamine wherein the ethyleneamine has an average molecular weight of about 150 to about 500.

16. A process for brownstock washing of cellulose pulp containing lignin with a washing composition, the improvement comprising using a washing composition consisting essentially of an aqueous solution of at least about 100 ppm of an ethyleneamine wherein the ethyleneamine has an average molecular weight of about 150 to about 500.

* * * * *